US005194875A

United States Patent [19]

Lucas

[11] Patent Number: 5,194,875

[45] Date of Patent: Mar. 16, 1993

[54] NOTCH RADIATOR ELEMENTS

[75] Inventor: Eric W. Lucas, Ellicott City, Md.

[73] Assignee: Westinghouse Electric Corp., Pittsburgh, Pa.

[21] Appl. No.: 711,846

[22] Filed: Jun. 7, 1991

[51] Int. Cl.[5] ..... H01Q 13/10

[52] U.S. Cl. ..... 343/767

[58] Field of Search ..... 343/767, 702, 786, 795

[56] References Cited

U.S. PATENT DOCUMENTS 4,001,834 1/1977 Smith ..... 343/795
4,353,672 10/1982 Monser ..... 343/786
4,573,056 2/1986 Dedome et al. ..... 343/795
4,672,384 6/1987 Roy et al. ..... 343/786

*Primary Examiner*—Michael C. Wimer
*Attorney, Agent, or Firm*—W. G. Sutcliff

[57] ABSTRACT

A radiator has a planar dielectric substrate which supports a stripline conductor therein. A conductive housing receives and encloses the dielectric and isolates the stripline from adjacent structures. The housing has a radiator with a high impedance termination and the dielectric has a stripline feed with a low impedance open circuit termination. The terminations result in an increased broad band response of the radiator.

13 Claims, 1 Drawing Sheet

NOTCH RADIATOR ELEMENTS

RELATED APPLICATION

This application is related to Ser. No. 07/674,003 filed Mar. 21, 1991, entitled "Notch Radiator Elements" in the name of Lucas et al., assigned to Westinghouse Electric Corporation, the teachings of which are incorporated hereby reference.

BACKGROUND OF THE INVENTION

1. Field of the Invention

The invention relates to notch radiator elements. In particular, the invention relates to wide band high frequency notch radiator devices employing circuit elements and machined arrangements for use in antenna arrays.

2. Description of the Prior Art

Known notch type radiator elements typically employ a double slot line tapered launch which has a narrow 50 ohm—50 ohm transition between a stripline and feed end of the slot line. The stripline and the slot line each transition. The stripline is buried within or sandwiched between planar dielectric substrates and the slot line is formed of etched metallized films on opposite sides of the substrate. The above-identified application of Lucas et al. has obviated some of the problems of planar dielectric radiators in radar class applications (~ 50% bandwidth). For certain EW applications, however, it is desirable to have a wide and width greater than 100% with respect to the center frequency for receiving energy transmission from unknown targets.

SUMMARY OF THE INVENTION

In one embodiment of the invention a planar dielectric substrate supports a signal carrying element therein in the form of a stripline having a feed end. A conductive housing having a cavity or pocket therein receives and encloses the dielectric and isolates the stripline from adjacent structures. The housing has aligned radiators disposed on opposite sides of the dielectric which have feed slots forming transitions with the stripline via electromagnetic proximity coupling. The stripline has a widened quarter wave open circuit termination, which reflects as a broad band short circuit. The feed slots have widened high impedance terminations which reflect as a broad band open circuit at the transition. The resulting radiating element has wide bandwidth greater than 100% with respect to the center frequency for diverse EW applications.

DESCRIPTION OF THE PREFERRED EMBODIMENT

Figure 1:
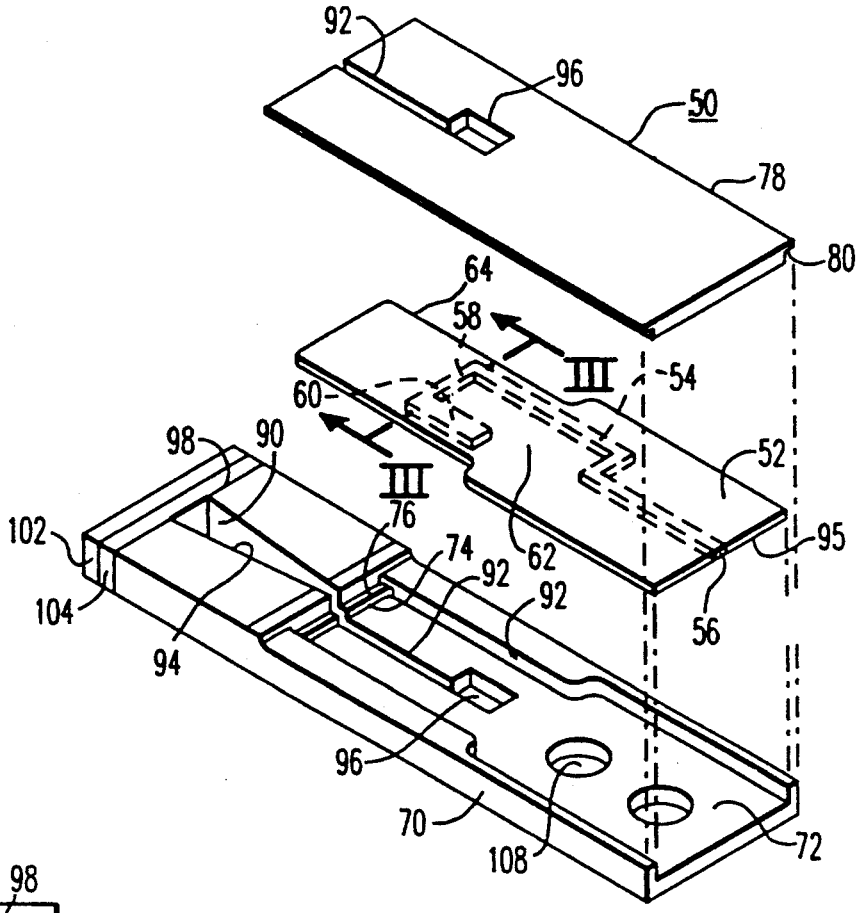
FIG. 1 is an exploded perspective view of a single element machined notch radiator according to the present invention.
Figure 2:
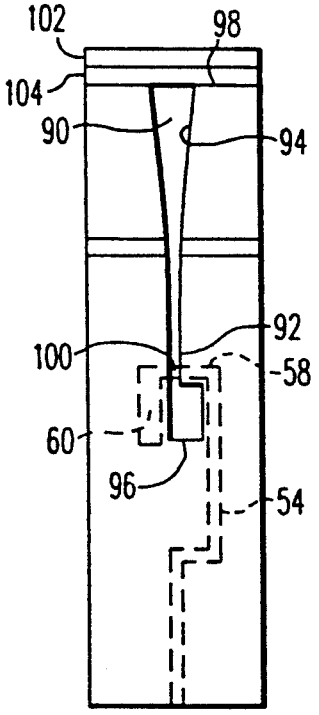
FIG. 2 is a schematic plan view of the radiator according to the present invention.
Figure 3:
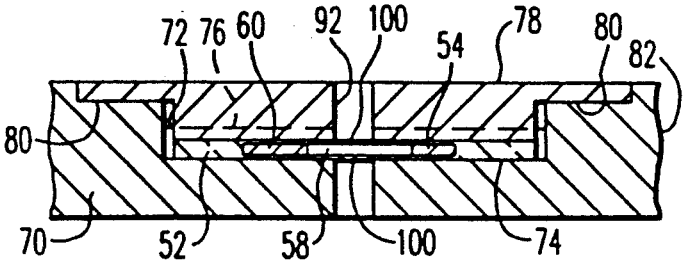
FIG. 3 is a sectional view of the arrangement of FIG. 1 along line 3—3 thereof.

Referring to FIG. 1 a single radiating element 50 in accordance with present invention is illustrated in exploded prospective view. It should be understood, however, that a plurality of such elements 50 may be provided in an array as described in the aboveidentified copending U.S. patent application. In the arrangement, a dielectric substrate 52 has a stripline 54 embedded therein. The impedance of the stripline 54 is typically 50 ohm. The stripline 54 has a terminal end 56 for coupling signals thereto, a feed end 58 which extends transversely of the stripline 54 and a widened, quarter wave, low impedance open circuit termination 60 coupled thereto as shown. The length of the termination 60 is one quarter wavelength of a selected mid-band frequency of interest. The dielectric 52 is shaped as shown and includes widened proximal end 62 and narrow distal end 64. A planar conductive housing 70 has a stepped recess or pocket 72. A lower portion 74 is shaped to receive the substrate 52 therein as illustrated. The stepped recess 72 has second or upper portion 76 adjacent the lower portion 74, and a conductive cover 78 is adapted to be located in the upper portion 76 over the dielectric 52 and in electrical contact with the housing 70. The cover 78 has a mating surface 80 which is designed to mate with the upper portion 76 and contact stepped side walls 82 of the housing 70. The side walls 82 isolate adjacent elements from spurious signals.

The housing 70 and the cover 78 have respective axially aligned dual slot lines or radiators 90, which include narrow double feed slots 92. Circular transitions 94 and widened quarter wave high impedance terminations 96 are coupled to opposite ends of the feed slots 92. A free space interface, output end or aperture 98 of the housing 70 is coupled to the circular transitions 94 as shown. The dielectric 52 is so located in the stepped recess 74 such that the feed end 58 of the stripline 54 lies transversely with respect to the feed slots 92 to thereby form transitions 100. Dielectric matching layers 102 and 104 may be provided to increase coupling efficiency between the radiator 90 and free space.

The output end or aperture 98 of the element 50 may be tapered or beveled as shown in the above referenced copending application. The purpose of the taper is to reduce structural cross polarization reflections at the aperture 90. Advantageously, however, it has been found that performance is not adversely affected when the output end or free space interface 98 is untapered or square, as shown, which allows for ease of manufacture. In a preferred embodiment, the stepped recess 72, the cover 78 and the optional taper are machined from aluminum stock. If desired, one or more circulator chambers 108 may be provided as room permits. The components of radiators 90 including circular transition 94, feed slots 92 and terminations 96 may be machined using an electric discharge machining (EDM) technique.

The invention differs from prior arrangements primarily in the region near the transitions 100. Instead of a highly optimized 50 ohm—50 ohm quarter wave transition between the stripline 58 and the feed slots 92, the transitions 100 have a wide band characteristic. The impedance between the stripline 54 and the feed slot 92 is specially tailored. The high impedance termination 96 of the feed slots 92 is in the form of a widened dual slot line quarter wave extension. This type of high impedance termination reflects as an broad band open circuit at the transitions 100. The stripline 54 termination 60 is in the form of a widened open circuit quarter wave stub which has a reduced impedance. This type of termination reflects as a broad band short at the transitions 100. The described arrangement broadens the response of the radiator 50 by allowing signals to pass between the stripline 54 and the feed slot 92 without significant loss.

Coupling occurs by electromagnetic proximity coupling of a field induced in the transition 100. The high impedance termination 96 of the feed slot 92 and the low impedance termination 60 of the stripline 54 maximizes signal energy transfer. The arrangement slightly raises the VSWR characteristic but not to an unacceptable level. For example, VSWR is typically about 2:1 or better over a bandwidth of about 2.75 GHz—18 GHz, for a standard grid array of multiple radiators, (not shown, but illustrated in greater detail in the copending application mentioned above,) being half wave spaced at 18 GHz. As will be apparent to those skilled in the art, bandwidth performance will vary with periodicity of the array as well as with the frequency dependent component design of the radiator.

While there has been described what at present is believed to be the preferred embodiment of the present invention, it will be apparent to those skilled in the art the various changes and notifications may be made therein without departing from the invention, and is intended in the appended claims to cover all such modifications and changes that come within true spirit and scope of the invention.

What is claimed is:

1. A broad band radiator for high frequency signals comprising:

a planar dielectric substrate;

at least one conductive strip having a low impedance open circuit termination supported within the dielectric substrate;

a planar housing member formed of a rigid self supporting conductor having a recess for receiving the dielectric substrate therein, said conductor having a solid portion with an aperture therein and extending from one end thereof radiating signals in free space; and a rigid conductive cover mounted in the recess and over the dielectric substrate in contact with the housing member for enclosing and isolating the dielectric substrate and the conductive strip, said housing and cover each having formed therein a feed slot and a high impedance termination coupled thereto, said feed slot being in communication with the recess and extending over the dielectric substrate into the solid aperture portion, the feed slot disposed proximate to the conductive strip on the opposite sides of the dielectric substrate in a direction transverse thereto forming a transition representing a discontinuity with respect to the conductive strip and the feed slot for coupling broad band signals between the conductor and the aperture portion by electromagnetic proximity coupling of a field induced in the transition, said low impedance termination reflecting as a broad band short circuit at the transition and the high impedance termination reflecting as a broad band open circuit at the transition.

2. The radiator element of claim 1 wherein the conductive strip comprises a printed circuit element.

3. The radiator element of claim 1 wherein a portion of the conductive strip is disposed transversely with respect to the slot.

4. The radiator element of claim 1 wherein the transition comprises a portion of the feed slot transverse of the conductive strip for launching the signal induced by the field cooperating therewith, and the high impedance termination comprises a widened slot portion connected to the feed slot for establishing a signal feed impedance.

5. The radiator element of claim 1 wherein the high impedance termination is formed of a widened portion of the said feed slot increasing the impedance thereof which reflects as a wide band open circuit at the transition.

6. The radiator element of claim 1 wherein the low impedance termination includes a conductive end portion of the conductive strip being widened with respect to said conductive strip to decrease the impedance thereof.

7. The radiator element of claim 6 wherein the widened end portion reflects as a wide band short at the transition.

8. The radiator element of claim 1 wherein the recess is formed with lateral side walls for suppressing spurious signals laterally of the housing member.

9. The radiator element of claim 1 wherein the housing member and cover are machined by from metal stock.

10. The radiator element of claim 1 having a broad band with a bandwidth of greater than 100% with respect to a center frequency of operation.

11. The radiator element of claim 1 wherein the broad band response is between about 2.75 GHz–18 GHz for an array of radiators being half wave spaced at 18 GHz.

12. The radiator element of claim 11 wherein the broad band response has a VSWR of less than about 2:1.

13. The radiator element of claim 1, wherein the conductive strip is embedded within the dielectric substrate.

* * * * *